US007488011B2

(12) United States Patent
Seo et al.

(10) Patent No.: US 7,488,011 B2
(45) Date of Patent: Feb. 10, 2009

(54) BUTTON WRAPPING AND KNOTTING METHOD AND APPARATUS THEREOF

(75) Inventors: Myung-won Seo, Seoul (KR); Eui-Suk Oh, Seoul (KR)

(73) Assignee: Myung Jin S. M. Co., Ltd., Kyunggi-Do (KR)

( * ) Notice: Subject to any disclaimer, the term of this patent is extended or adjusted under 35 U.S.C. 154(b) by 461 days.

(21) Appl. No.: 10/564,122

(22) PCT Filed: Jul. 5, 2004

(86) PCT No.: PCT/KR2004/001657

§ 371 (c)(1),
(2), (4) Date: Jan. 4, 2006

(87) PCT Pub. No.: WO2005/002377

PCT Pub. Date: Jan. 13, 2005

(65) Prior Publication Data

US 2006/0174809 A1 Aug. 10, 2006

(30) Foreign Application Priority Data

Jul. 5, 2003 (KR) ..... 10-2003-0045538

(51) Int. Cl.
*A01D 59/04* (2006.01)

(52) U.S. Cl. ..... 289/2; 289/1.5

(58) Field of Classification Search ..... 289/1.5, 289/2–14

See application file for complete search history.

(56) References Cited

U.S. PATENT DOCUMENTS 5,082,151 A 1/1992 Schaerer ..... 112/108

FOREIGN PATENT DOCUMENTS

| | | | |
|---|---|---|---|
| JP | 62161393 A | * | 7/1987 |
| KR | 1019960009771 | | 7/1996 |
| KR | 1020030010877 | | 2/2003 |
| WO | WO 98/51174 | | 11/1998 |

* cited by examiner

*Primary Examiner*—Shaun R Hurley
(74) *Attorney, Agent, or Firm*—J.C. Patents

(57) ABSTRACT

A method and apparatus for winding and knotting a thread around a sewing thread of a button for clothes so that a gap between the button and a suit, on which the button is sewn, is maintained. The thread, which is twisted at least twice, passes over and winds around the sewing thread, thereby forming firm knots of the thread around the sewing thread and preventing the knots from being disentangled. Since guiding means accurately and reliably guides the thread to pass over the sewing thread, and the knot-guiding means and the thread take-up means of the apparatus are simultaneously operated by a single driving means, the invention performs firm and effective winding of the thread around the sewing thread and reduces production costs and energy consumption rate of the apparatus, and reduces failure rate, thereby improving reliability of winding and knotting the thread around the sewing thread.

10 Claims, 18 Drawing Sheets

BUTTON WRAPPING AND KNOTTING METHOD AND APPARATUS THEREOF

TECHNICAL FIELD

The present invention relates to a method and apparatus for winding and knotting a thread around a sewing thread of a button for clothes, and more particularly to a method and apparatus for winding and knotting a thread around a sewing thread of a button for clothes so that a gap between the button and clothes, on which the button is sewn, is maintained.

BACKGROUND ART

In order to easily fasten or unfasten a button for clothes, sewed to the clothes such as a suit or a Y-shirt, into or from a button hole of the clothes, a proper gap needs to be formed between the clothes and the button. For this reason, another thread winds around a sewing thread protruded from the rear surface of the button facing the clothes, and is then knotted.

In case that the button is sewed to the clothes as described above, the sewing thread of the button requires a designated solidity and a designated flexibility, thus preventing the button from sagging and allowing the button to be easily inserted into the button holes of the clothes. Further, the button, which was sewed to the clothes by an apparatus, must be fixed to the clothes without disentanglement of the sewing thread and the winding thread.

Conventionally, the winding of the general thread around the sewing thread of the button in order to satisfy the above requirements was achieved by a manual manipulation. That is, the sewing thread protruded from the rear surface of the button is wounded by the general thread manually, and is then knotted. The above conventional method is disadvantageous in that it is complicated and requires a long time.

Many solutions to solve the above problems were developed, and a special thread, which does not requiring knotting, has been developed. The above special thread is an elastic thread made of plastic material such as elastomer. The elastic thread is advantageous in that it has a designated adhesivity and thus is not unwound without knot, but is disadvantageous in that it is unwound because it loses its adhesivity after washing several times. Further, the elastic thread is expensive compared to the general thread. Thus, apparatus for winding and knotting a general thread around a sewing thread of a button for clothes, which is cheaper than the elastic thread, are being developed now, and many patents and utility models regarding to such the apparatus have been filed.

FIG. 1 is a schematic view illustrating a method for winding and knotting a thread around a sewing thread of a button for clothes using a conventional knotting apparatus.

As shown in FIG. 1, a button for clothes 1 is sewed to clothes 2 by a sewing thread 3. A general thread 4, which winds a portion of the sewing thread 3 protruded from the rear surface of the button 1, is twisted once per winding. Thereby, a knot 5 is formed each winding of the general thread 4 around the sewing thread 3.

Since the knot 5, which is formed each winding of the general thread 4 around the sewing thread 3, is obtained not by plaiting the general thread 4 but by twisting the general thread 4, when one end of the general thread 4 is drawn, the knots 5 of the general thread 4 are easily disentangled. Further, when the general thread 4 with the knots 5 winding the sewing thread 3 is fixed to the sewing thread 3, the general thread 4 is easily separated from the sewing thread 3. In order to solve the above separation of the general thread 4 from the sewing thread 3, an additional air blast device, for blowing the general thread 4 toward the sewing thread 3, is required.

DISCLOSURE OF THE INVENTION

Therefore, the present invention has been made in view of the above problems, and it is an object of the present invention to provide a method for winding and knotting a thread around a sewing thread of a button for clothes, in which firm knots of the thread onto the sewing thread are formed using an apparatus, thereby preventing the knots of the thread from being disentangled and thus preventing the thread from being unwounded from the sewing thread.

It is another object of the present invention to provide an apparatus for winding and knotting a thread around a sewing thread of a button for clothes, in which the thread firmly and automatically winds around the sewing thread protruded from the rear surface of the button and knots of the thread are obtained, thereby preventing the button from being separated from clothes.

In accordance with one aspect of the present invention, the above and other objects can be accomplished by the provision of a method for winding and knotting a thread around a sewing thread of a button for clothes, comprising the steps of: (a) fixing one end of the thread to the sewing thread of the button, and extending the thread to wind around the sewing thread of the button in a circular shape; (b) further extending the thread to wind around the sewing thread of the button at least once in the same direction of the preceding winding; (c) allowing the circular portion of the thread to pass over the sewing thread; and (d) forming a double-twisted knot of the thread by drawing the other end of the thread.

Preferably, the thread may be extended to wind around the sewing thread of the button just once in the same direction of the preceding winding in step (b), and the extended thread may wind around the sewing thread of the button, in the circular shape in a clockwise or counterclockwise direction in step (a).

In accordance with another aspect of the present invention, there is provided an apparatus for winding and knotting a thread around a sewing thread of a button for clothes, comprising: a base, on which a plurality of components are installed; button-holding means installed on the base for holding the button; knot-guiding means installed in front of the button-holding means for guiding the thread so that the thread passes over the sewing thread protruded from the button held by the button-holding means to form a knot; winding means, installed on an upper surface of the base, including a conveying stand moving back and forth toward the button-holding means, a winding arm for winding the thread around the sewing thread of the button, and first driving means for rotating the winding arm; thread take-up means, installed on the base, including a thread hole formed through one side thereof for passing the thread and a thread take-up member for straining the thread when the thread passes over the sewing thread of the button; second driving means installed on the base for simultaneously supplying power to the knot-guiding means and the thread take-up means; and tension means, for adjusting the tension of the thread, including having a first tension member and a second tension member, between which the thread take-up means is positioned.

Preferably, the knot-guiding means may include guide arms having arc-shaped upper ends so that the arc-shaped upper ends face each other and outer circumferences of the upper ends form a circle, and guide grooves, in which the thread is inserted, may be respectively formed in the outer circumferences of the arc-shaped upper ends.

Further, preferably, the winding arm of the winding means may include a first tubular member connected to a rotary shaft of the first driving means by a belt; a connection arm connected to one end of the first tubular member at right angles; and a second tubular member connected to the connection arm at right angles and extended toward the button-holding means in parallel with the first tubular member.

Preferably, the thread take-up means may further include a thread-straining member having one end, which is fixed to the thread take-up means by a pin, and the other end, which is freely rotatable and has a thread hole formed therethrough.

In the method and apparatus of the present invention, the external thread is supplied to the sewing thread through the thread take-up means and the winding means and winds around the sewing thread of the button held by the button-holding means, passes over the sewing thread of the button so that a double-twisted knot of the thread is formed by the knot-guiding means, and is strained by the operation of the thread take-up means when the knot-guiding means is operated.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, preferred embodiments of the present invention will be described in detail with reference to the annexed drawings.

As shown in FIGS. 2 to 5, one end of a thread 20 is fixed to a sewing thread 11 protruded from the rear surface of a button 10 for clothes, and the thread 20 is extended so that it winds around the sewing thread 11 of the button 10 in a circular shape. Here, the winding of the thread 20 may be in any direction, i.e., clockwise or counterclockwise.

The thread 20 is more extended so that it winds again around the sewing thread 11 of the button 10 at least once in the same direction of the preceding winding. Here, the number of windings of the thread 20 may be plural. When the number of windings of the thread 20 is plural, it is difficult to unwind the thread 20 by drawing the other end of the thread 20. Accordingly, preferably, the number of windings of the thread 20 is one.

The end of the thread 20, wound around the sewing thread 11 of the button 10 in a circular shape, passes over the button 10 and winds around the sewing thread 11 of the button 10 in numerical order as shown in FIGS. 2 to 5.

Figure 5:
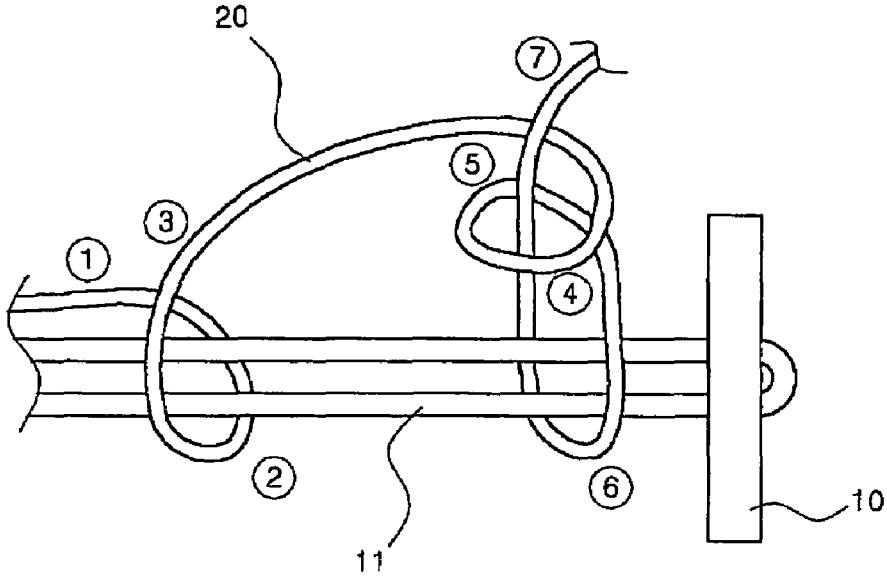

Then, when the other end of the thread 20 wound around the sewing thread 11 of the button 10 is drawn, a knot obtained by twisting the thread 20 twice is formed as shown in FIG. 5. The obtained firm knot is not easily disentangled even by drawing any end of the thread 20.

Figure 6:
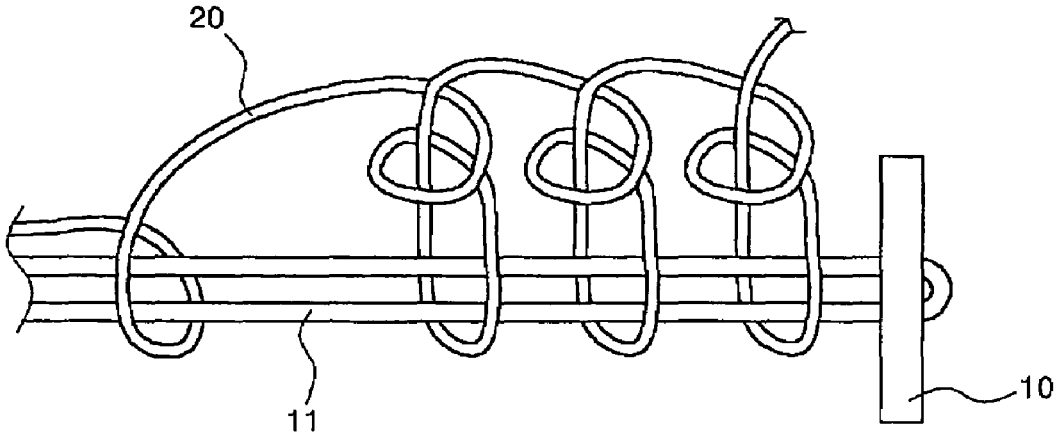
FIG. 6 is a schematic view of one example of a button for clothes, the sewing thread of which was wounded and knotted by the method of the present invention.

FIG. 6 illustrates a plurality of the continuously obtained knots of the thread 20. Although not shown in FIG. 6, the knots may be formed in different directions.

Hereinafter, an apparatus for winding and knotting a thread around a sewing thread of a button for clothes will be described in detail with reference to the annexed drawings.

Figure 7:
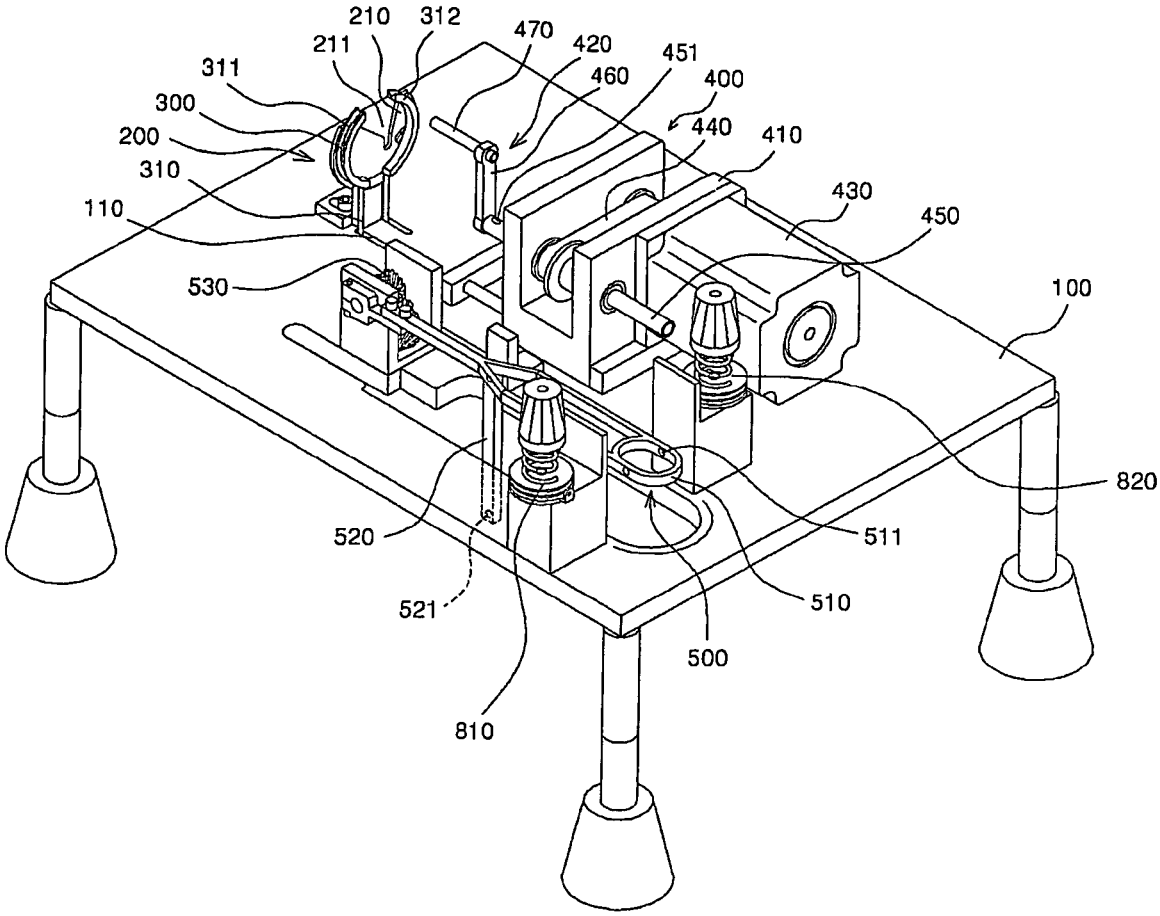
FIG. 7 is a perspective view of an apparatus for winding and knotting a thread around a sewing thread of a button for clothes in accordance with one embodiment the present invention.
Figure 8:
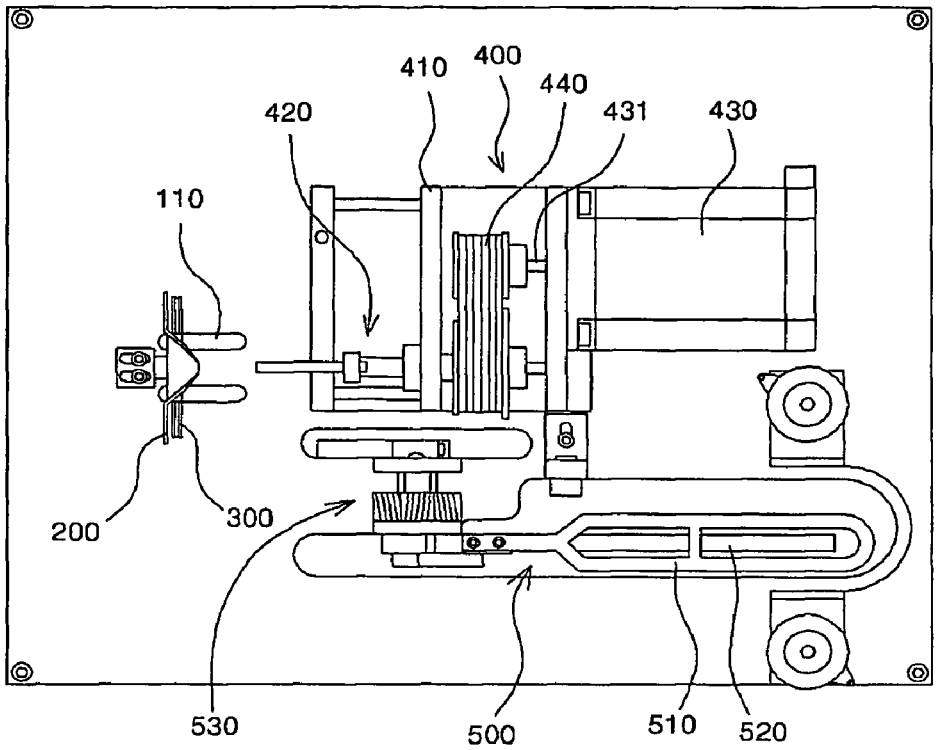
FIG. 8 is a plan view of the apparatus in accordance with one embodiment the present invention.
Figure 9:
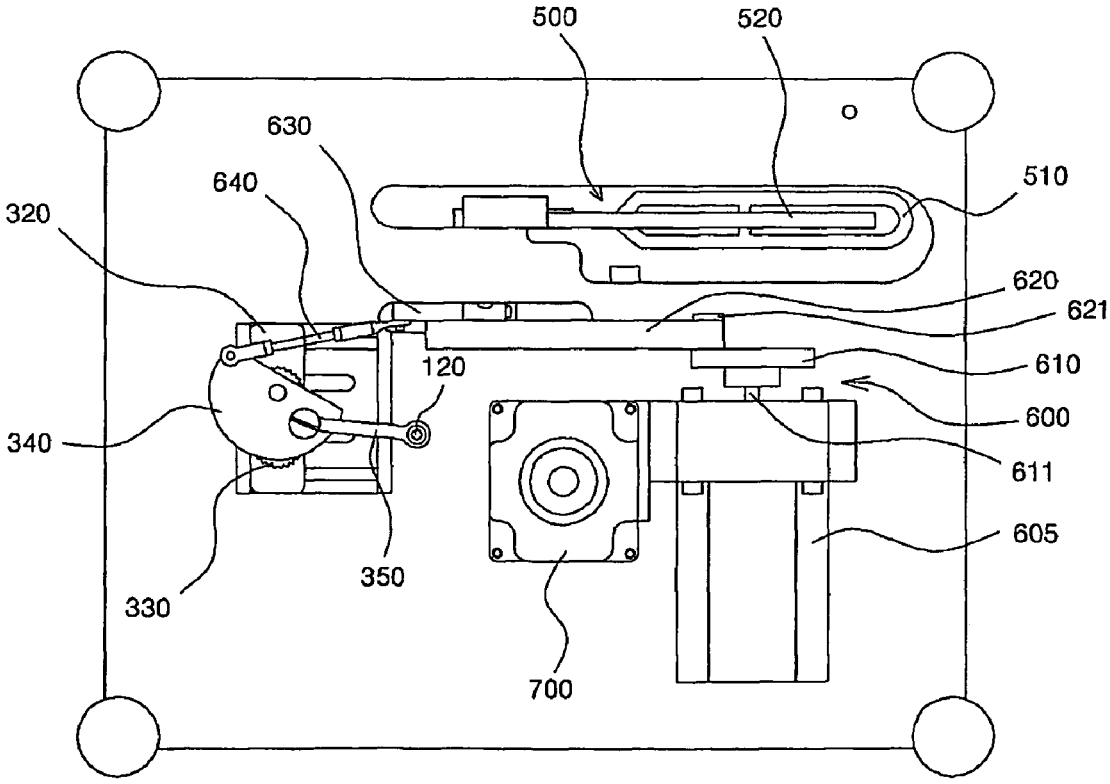
FIG. 9 is a bottom view of the apparatus in accordance with one embodiment the present invention.

FIG. 7 is a perspective view of an apparatus for winding and knotting a thread around a sewing thread of a button for clothes in accordance with one embodiment the present invention. FIG. 8 is a plan view of the apparatus, and FIG. 9 is a bottom view of the apparatus.

The apparatus for winding and knotting a thread around a sewing thread of a button for clothes in accordance with the present invention comprises a base 100, on which a plurality of components are installed; button-holding means 200 installed on the base 100 for holding the button; knot-guiding means 300 installed in front of the button-holding means 20 for guiding the thread 20 so that the thread 20 passes over the sewing thread protruded from the button 10 held by the button-holding means 200 to form a knot; winding means 400, installed on the upper surface of the base 100, including a conveying stand 410 moving back and forth toward the button-holding means 200, a winding arm 420 for winding the thread 20 around the sewing thread 11 of the button, and first driving means 430 for rotating the winding arm 420; thread take-up means 500, installed on the base 100, including a thread hole 511 formed through one side thereof for passing the thread 20 and a thread take-up member 510 for straining the thread when the thread passes over the sewing thread of the button; second driving means 600 installed on the base 100 for supplying power to the knot-guiding means 300 and the thread take-up means 500 so that the knot-guiding means 300 and the thread take-up means 500 are simultaneously driven; and tension means 800 having a first tension member 810 and a second tension member 820, between which the thread take-up means 500 is positioned, for adjusting the tension of the thread 20.

Now, the above-described components of the apparatus will be described in detail.

The button-holding means 200 includes a button holder 210 installed at one side of the base 100 for holding the button sewed to clothes. A V-shaped button-holding groove 211 is formed in the upper surface of the button holder 210.

Upper ends 311 and 312 of guide arms 310 of the knot-guiding means 300 are arc-shaped, and the above arc-shaped upper ends 311 and 312 face each other such that the outer circumferences of the upper ends 311 and 312 form a circle. Guide grooves 311*a* and 312*a* for receiving the thread 20 are respectively formed in the outer circumferences of the upper ends 311 and 312.

The knot-guiding means 300 includes the bar-shaped guide arms 310 in a pair, which are positioned below the lower surface of the base 100, extended upwardly through a through hole 110 of the base 100, a guiding means-conveying member 320 inserted into the lower ends of the guide arms 310 and installed on a feed shaft for allowing the knot-guiding means 300 to move back and forth, gears 330 respectively fixed to the lower ends of the guide arms 310 so that the gears 330 are engaged with each other, and a driving plate 340 fixed to the lower end of one of the guide arms 310.

A first rod 350 includes one end fixed to a designated position of the driving plate 340 and the other end connected to a stationary shaft 120 placed at a designated position of the lower surface of the base 100 around the knot-guiding means 300.

The winding arm 420 of the winding means 400 includes a first tubular member 450 connected to a rotary shaft 431 of the first driving means 430 by a belt 440, a connection arm 460 connected to one end of the first tubular member 450 at right angles, and a second tubular member 470 connected to the connection arm 460 at right angles and extended toward the button-holding means 200 in parallel with the first tubular member 450.

The first tubular member 450 and the second tubular member 470 are hollowed, thus conveying the thread 20 through the hollows thereof. Since an outlet 451 is formed through the end of the first tubular member 450, which is connected to the connection arm 460, the thread 20, entered into the other end of the first member 450, is taken out of the outlet 451. The thread 20, taken out of the outlet 451 of the first tubular member 450, enters into the second tubular member 470, passes through the second tubular member 470, and then winds around the sewing thread 11 protruded from the rear surface of the button 10 held by the button-holding means 200.

The thread take-up means 500 further includes a thread-straining member 520 provided with one end 523, which is fixed, and the other end 524, which is freely rotatable and has a thread hole 521 formed therethrough, and a gear unit 530 having one gear 531 fixedly connected to the thread take-up member 510 so that the thread take-up member 510 can be rotated at a designated angle to strain the thread 20 at a designated length.

The second driving means 600 includes a second driving motor 605 attached to the lower surface of the base 100, a driving plate 610 installed on a driving shaft 611 of the second driving motor 605, a second rod 620 provided with one end 621 fixed to the driving plate 610 by a rotary pin 622 and extended in parallel with the driving plate 610, a third rod 630 provided with one end connected to the other end of the second rod 620 and the other end fixedly connected to the other gear 532 of the gear unit 530 of the thread take-up means 500, and a fourth rod 640 provided with one end connected to one end of the third rod 630 and the other end connected to the driving plate 340 of the knot-guiding means 300. The second driving means 600 supplies the driving force of the second driving motor 605 simultaneously to the knot-guiding means 300 and the thread take-up means 500.

Non-described reference numeral 700 in FIG. 9 represents third driving means, which is driven when the conveying stand 410 of the winding means 400 moves back and forth toward the button-holding means 200.

The first tension member 810 serves to supply the thread 20 supplied from the outside to the thread take-up means 510 and to adjust the tension of the thread 20 when the thread 20 is knotted, and the second tension member 820 serves to hole the thread 20 having passed through the thread take-up means 510 and to adjust the tension of the thread 20 when the thread 20 passes over the button 10.

Now, the operation of winding and knotting the thread around the sewing thread of the button using the above-described apparatus will be described in detail with reference to the annexed drawings.

Figure 29:
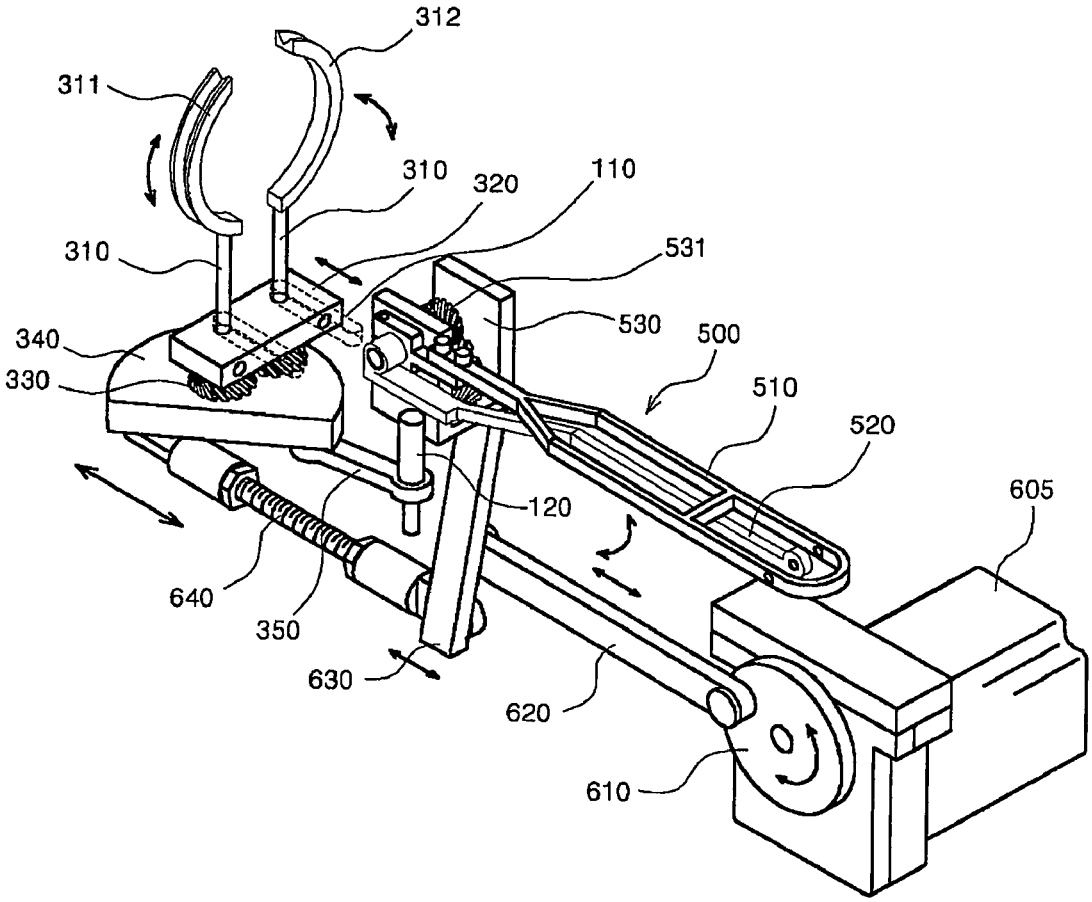
FIG. 29 is a perspective view illustrating a first state of guiding means and thread take-up means, which are simultaneously operated by second driving means.
Figure 30:
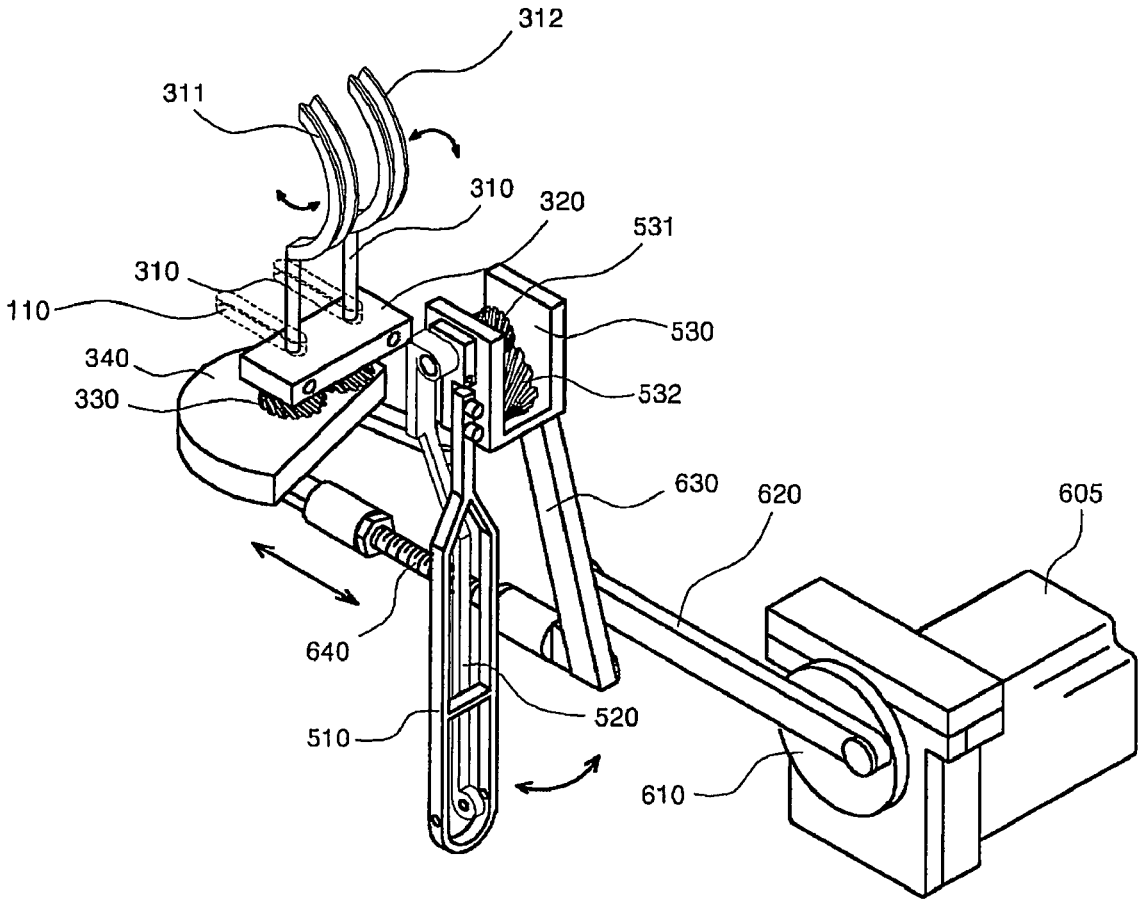
FIG. 30 is a perspective view illustrating a second state of the guiding means and the thread take-up means, which are simultaneously operated by the second driving means.

Particularly, FIGS. 29 and 30 illustrate only principal parts of the knot-guiding means and the thread take-up means, which are simultaneously driven by the second driving means, for convenience of understanding.

The thread 20, which is supplied from the outside, enters into one end of the first tubular member 450 of the winding means 400 adjacent to the first driving means 430, and is then taken out of the outlet 451 formed through the other end of the first tubular member 450 of the winding means 400 adjacent to the connection arm 460. The thread 20, which was taken out of the outlet 451, enters into one end of the second tubular member 470, passes through the second tubular member 470, and is then fixed onto the sewing thread 11 of the button 10.

The button 10 provided with the sewing thread 11, onto which the thread 20 is fixed, is held by the button holder 210 of the button-holding means 200. Here, the sewing thread 11 of the button 10 is supported by the button-holding groove 211.

Figure 10:
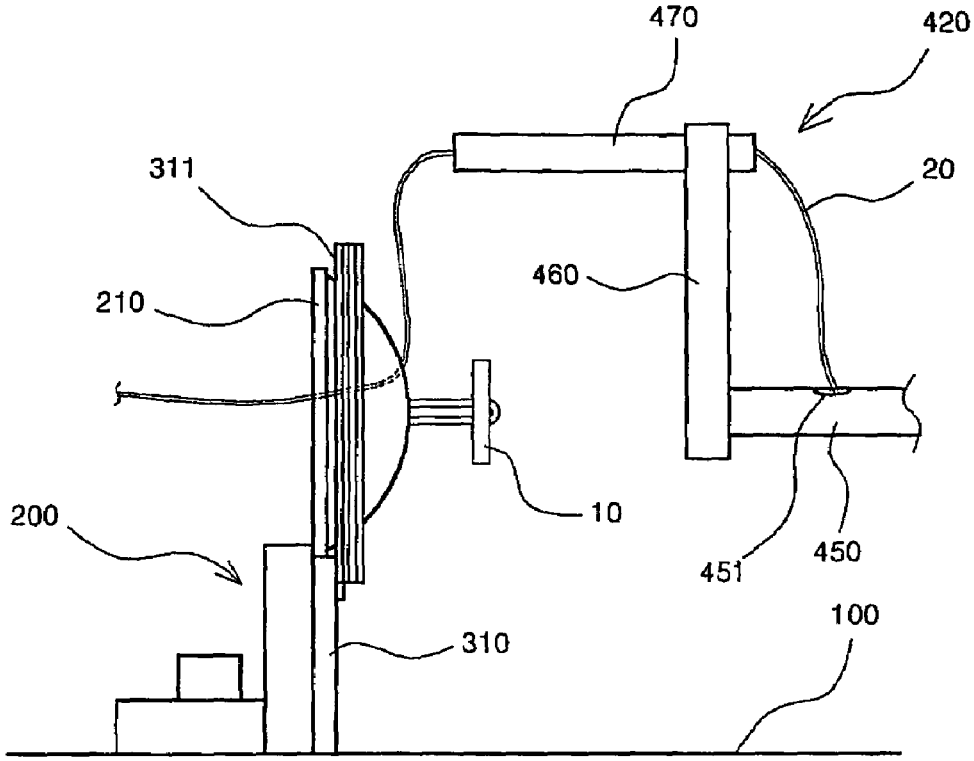
FIG. 10 is a front view illustrating a first state of the apparatus in accordance with the present invention.

A first state of the apparatus of the present invention as shown in FIG. 10 is a ready state. Now, a process for winding and knotting a thread around a sewing thread of a button for clothes in accordance with the present invention will be described in detail with reference to the annexed drawings.

In the ready state, the arc-shaped ends 311 and 312 of the guide arms 310 of the knot-guiding means 300 face each other and are spaced from each other such that the outer circumferences thereof form a circle, and the second tubular member 470 of the winding means 400 is placed above the sewing thread 11 of the button 10 so that the thread 20 can wind around the sewing thread 11 of the button 10 by the rotation of the second tubular member 470.

Thereafter, when the second tubular member 470, which is placed above the sewing thread 11 of the button 10, is rotated at an angle of 180°, the winding of the thread 20 around the sewing thread 11 of the button 10 is started as shown in FIG.

Figure 3:
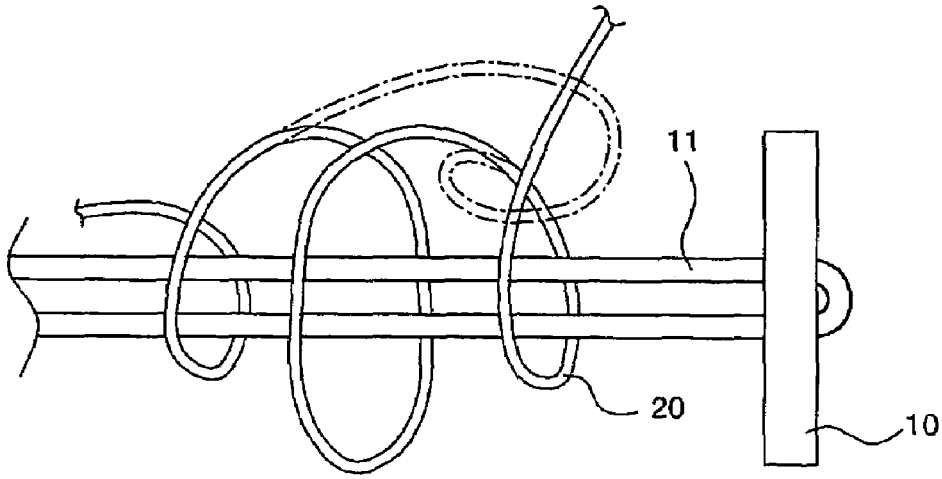
Figure 4:
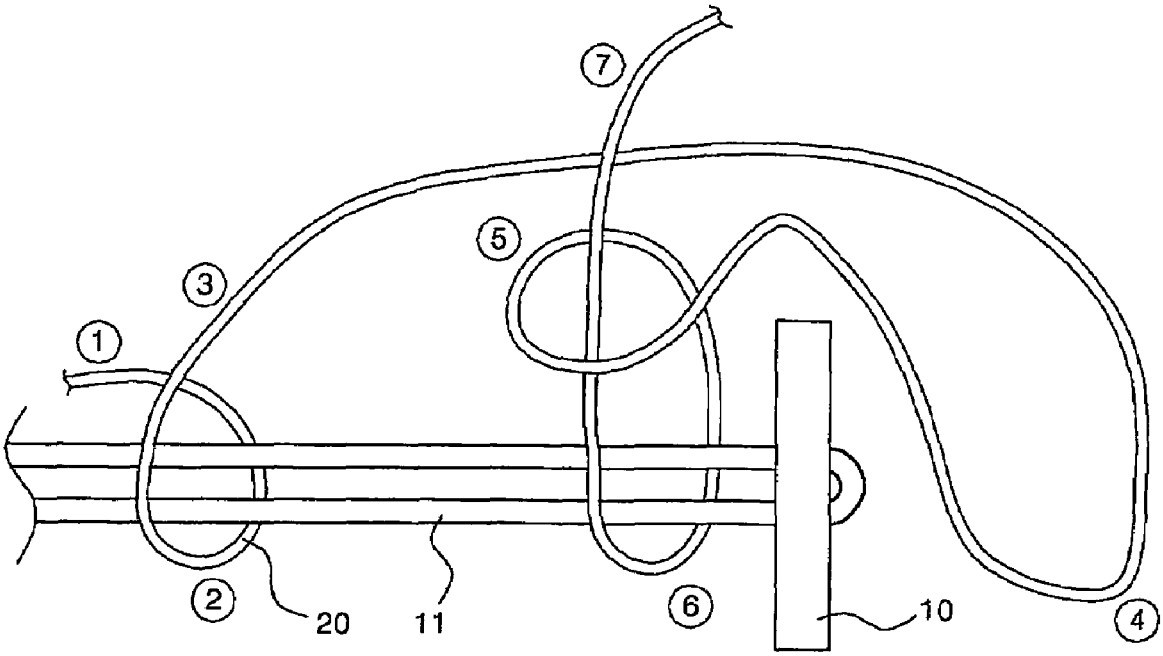
Figure 11:
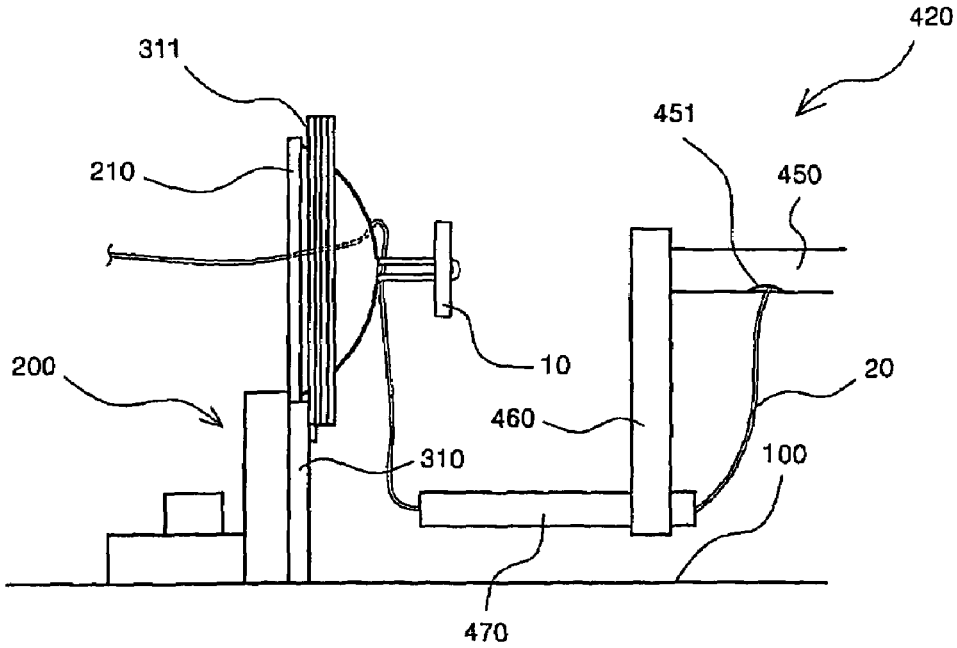
FIG. 11 is a front view illustrating a second state of the apparatus in accordance with the present invention.

11. With reference to FIG. 3, the position of the thread 20 in FIG. 10 corresponds to reference numeral ① of FIG. 3, and the position of the thread 20 in FIG. 11 corresponds to reference numeral ② of FIG. 3.

Figure 12:
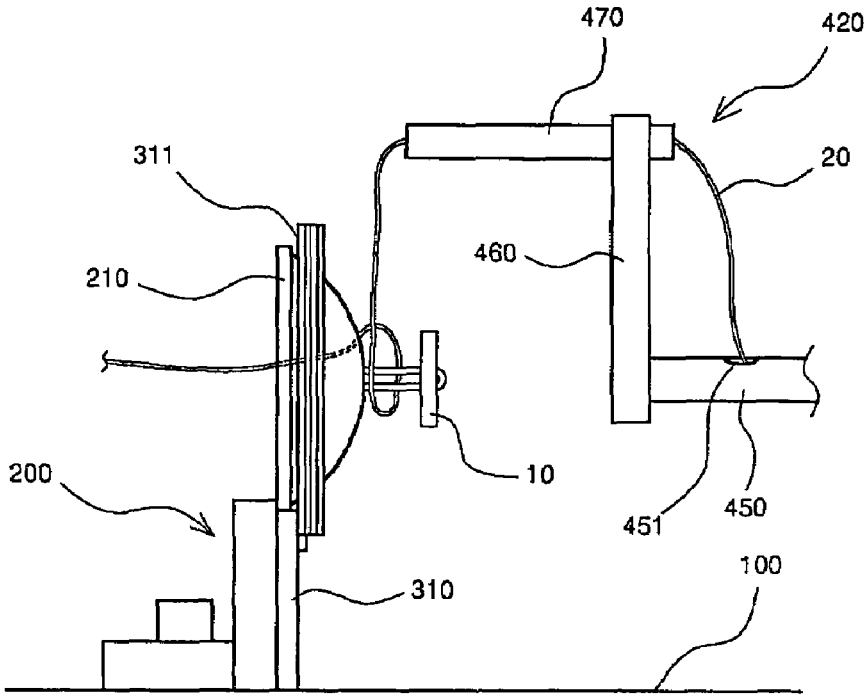
FIG. 12 is a front view illustrating a third state of the apparatus in accordance with the present invention.

FIG. 12 illustrates a state of the apparatus, in which the thread 20 completely wound around the sewing thread 11 of the button 10 once, and the position of the thread 20 in FIG. 12 corresponds to reference numeral ③ of FIG. 3. Here, the second tubular member 470 is placed above the sewing thread 11 of the button 10 similarly to FIG. 10. The position of the second tubular member 470 in FIG. 12 is obtained by rotating the second tubular member 470 from the position in FIG. 10 at an angle of 360°.

Figure 13:
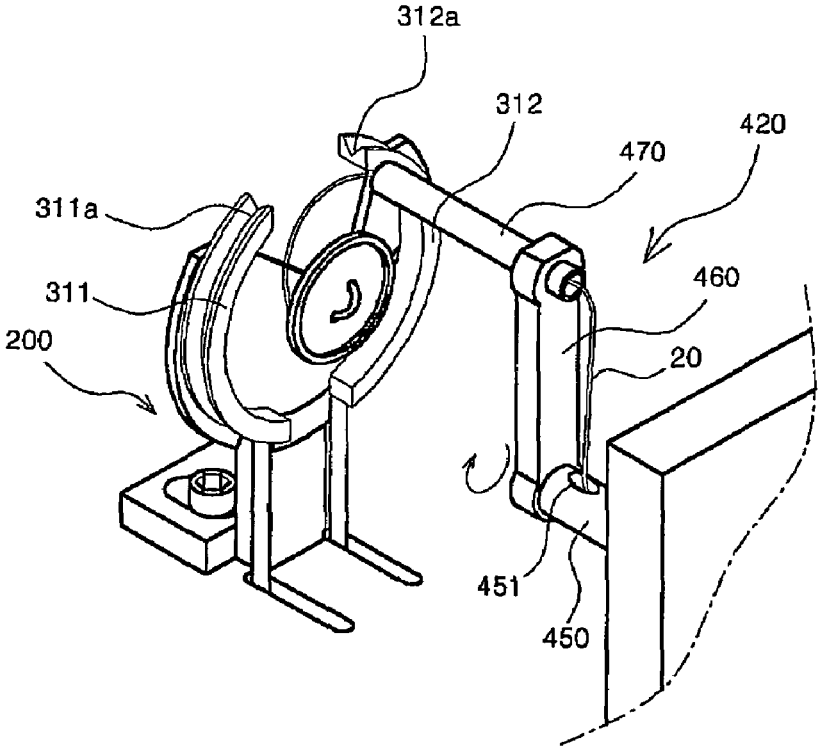
FIG. 13 is a perspective view of the apparatus in the third state of FIG. 12.

FIG. 13 is a perspective view of the apparatus in the state of FIG. 12, in which the thread 20 wound around the sewing thread of the button 10.

The above simple winding of the thread 20 is achieved by the control of a controller (not shown). Here, the components of the apparatus are driven by the control of the controller.

The first driving means 430 is driven based on the control of the controller, thereby rotating the winding arm 420 and performing the winding operation in which the thread 20 winds around the sewing thread of the button 10 a designated number of times. Preferably, after the winding operation is performed plural times, the knotting operation, in which the thread 20 is knotted, is performed.

In case that the winding operation is performed plural times, preferably, the third driving means 700 repeatedly moves back and forth by the length of the sewing thread 11 protruded from the rear surface of the button 10 based on the control of the controller so that the thread 20 uniformly winds around the sewing thread 11 of the button 10.

After the winding of the thread 20 around the sewing thread 11 of the button 10 by the designated number is performed, the second tubular member 470, which is placed above the sewing thread 11 of the button 10, is stopped, thereby allowing the winding operation to be terminated. Thereafter, the knotting operation is started.

Figure 14:
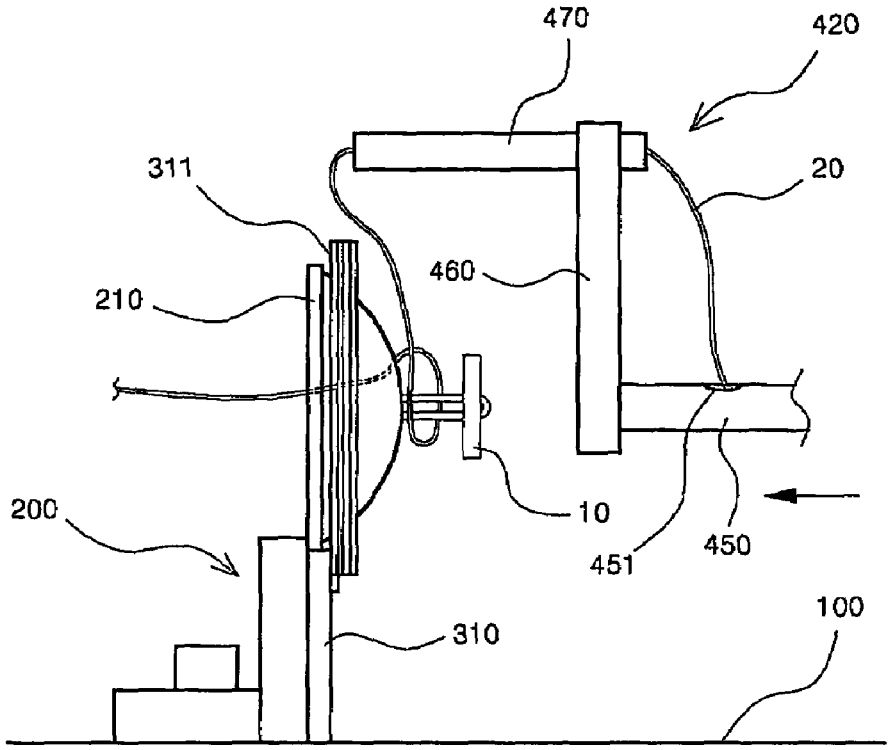
FIG. 14 is a front view illustrating a fourth state of the apparatus in accordance with the present invention.

FIG. 14 illustrates the apparatus in a state, in which the winding operation is terminated. The position of the thread 20 in FIG. 14 corresponds to reference numeral ③ of FIG. 3.

When the knotting operation is started, the winding means 400 moves by the third driving means 700. As shown in FIG. 14, the winding means 400 moves forward such that the end of the second tubular member 470 is placed above the upper ends 311 and 312 of the guide arms 310 of the knot-guiding means 300.

Figure 15:
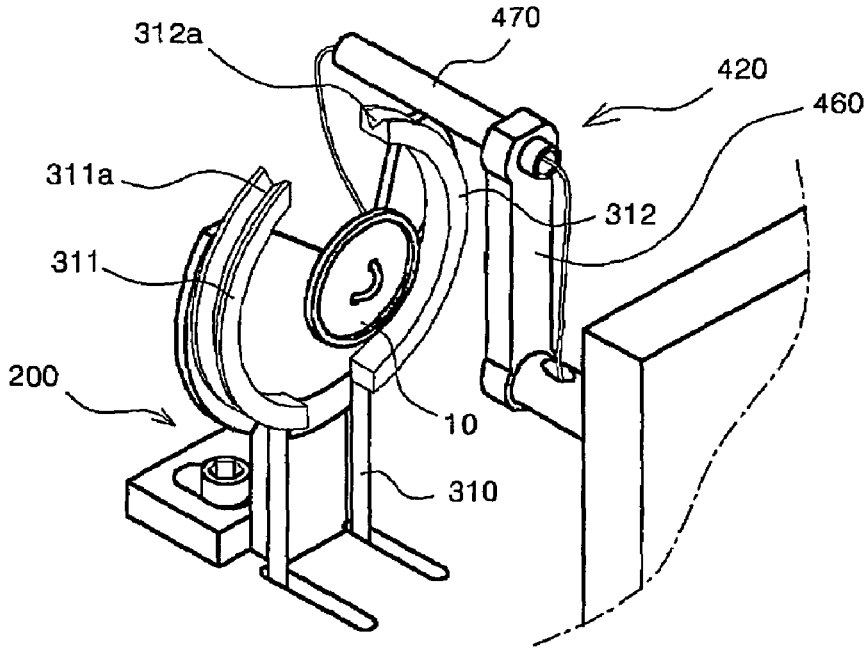
FIG. 15 is a perspective view of the apparatus in the fourth state of FIG. 14.
Figure 16:
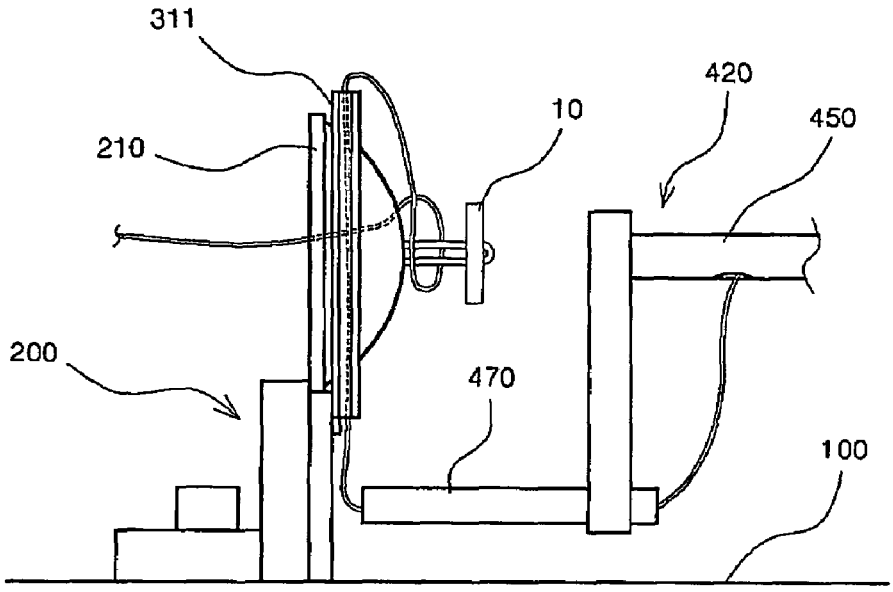
FIG. 16 is a front view illustrating a fifth state of the apparatus in accordance with the present invention.
Figure 17:
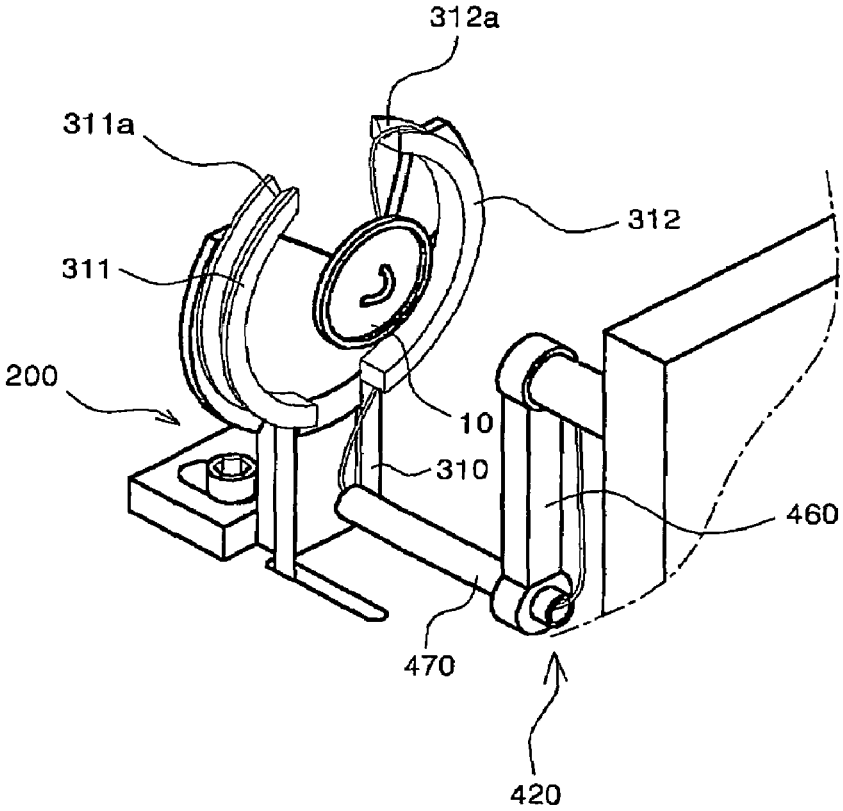
FIG. 17 is a perspective view of the apparatus in the fifth state of FIG. 16.

The above position of the winding means 400 is set to guide the thread 20 along the guide grooves 311*a* and 312*a* of the upper ends 311 and 312 of the guide arm 310 as shown in FIGS. 16 and 17. FIG. 14 is a front view of the apparatus in a state, in which the knotting operation is started, and FIG. 15 is a perspective view of the apparatus in the above state. The position of the thread 20 in FIGS. 14 and 15 corresponds to reference numeral ③ of FIG. 3.

FIGS. 16 and 17 illustrate the apparatus in a state, in which the second tubular member 470 is rotated in a designated direction by the winding means 400 at an angle of 180°. With reference to FIGS. 16 and 17, the thread 20 is guided by the guide groove 312*a* such that the thread 20 winds in a circle. The position of the thread 20 in FIGS. 16 and 17 corresponds to reference numeral ④ of FIG. 3.

Figure 18:
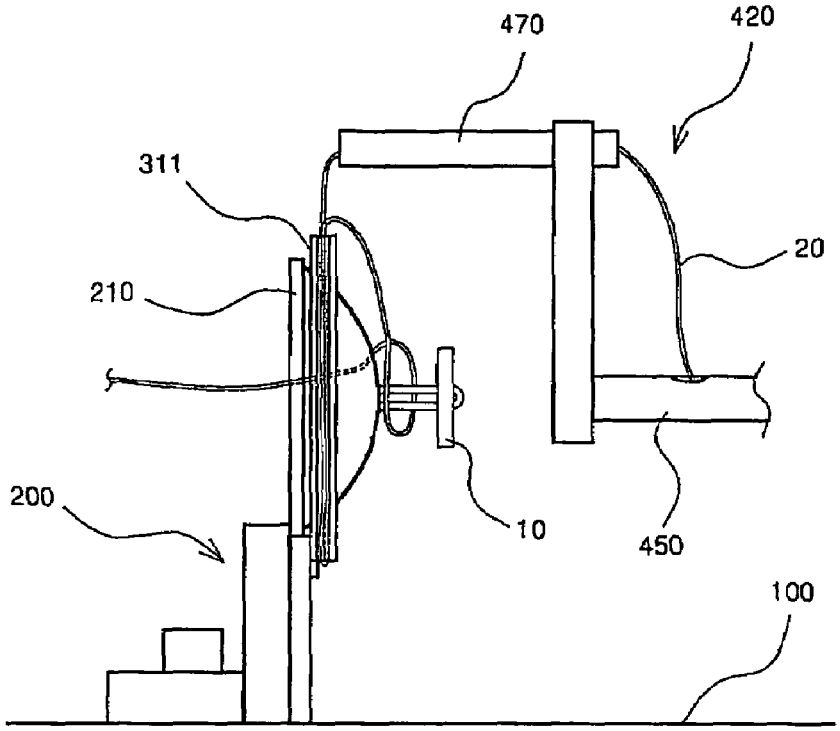
FIG. 18 is a front view illustrating a sixth state of the apparatus in accordance with the present invention.
Figure 19:
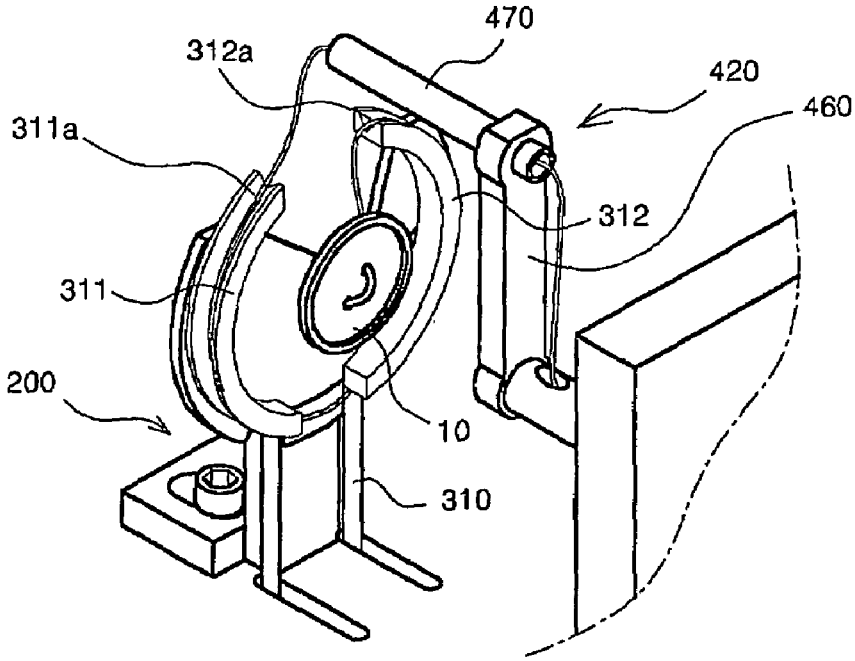
FIG. 19 is a perspective view of the apparatus in the sixth state of FIG. 18.

FIGS. 18 and 19 illustrate the apparatus in a state, in which the second tubular member 470 is rotated by the winding means 400 at an angle of 360°.

The second tubular member 470 is continuously rotated an angle of 360°. That is, the second tubular member 470 is rotated once. Here, the thread 20 is guided by the guide grooves 312*a* and 311*a* such that the thread 20 winds once. After the one rotation of the second tubular member 470, the second tubular member 470 is stopped. FIG. 19 is a perspective view of the apparatus in the state of FIG. 18, and the position of the thread 20 in FIGS. 18 and 19 corresponds to reference numeral ⑤ of FIG. 3.

Figure 20:
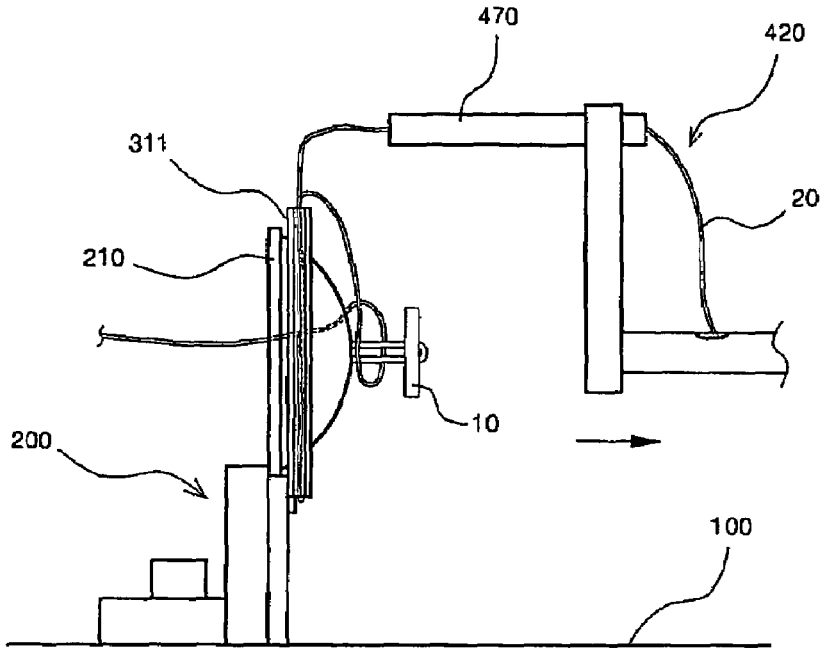
FIG. 20 is a front view illustrating a seventh state of the apparatus in accordance with the present invention.

As shown in FIG. 20, the winding means 400 moves back. That is, the winding means 400 moves back so that the end of the second tubular member 470 is placed above the sewing thread 11 protruded from the rear surface of the button 10, and then the backward movement of the winding means 400 is stopped.

Figure 21:
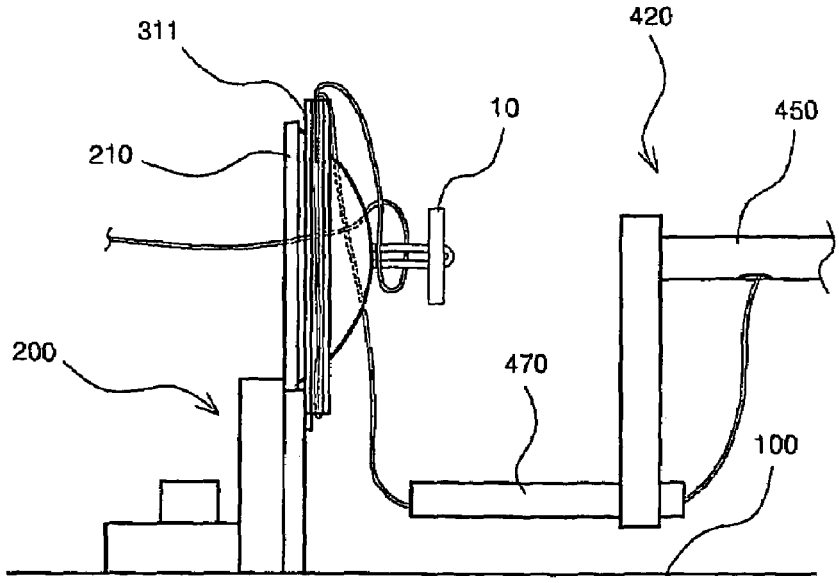
FIG. 21 is a front view illustrating an eighth state of the apparatus in accordance with the present invention.

Thereafter, the winding operation is performed again. Here, the present winding operation is performed in the same direction of the winding of the thread 20 along the guide grooves 312*a* and 311*a*. That is, when the second tubular member 470 is rotated by an angle of 180° under the condition that the second tubular member 470 is placed above the sewing thread 11 of the button 10, the thread 20 winds around the sewing thread 11 of the button 10 as shown in FIG. 20. The position of the thread 20 in FIG. 21 corresponds to reference numeral ⑥ of FIG. 3.

Figure 22:
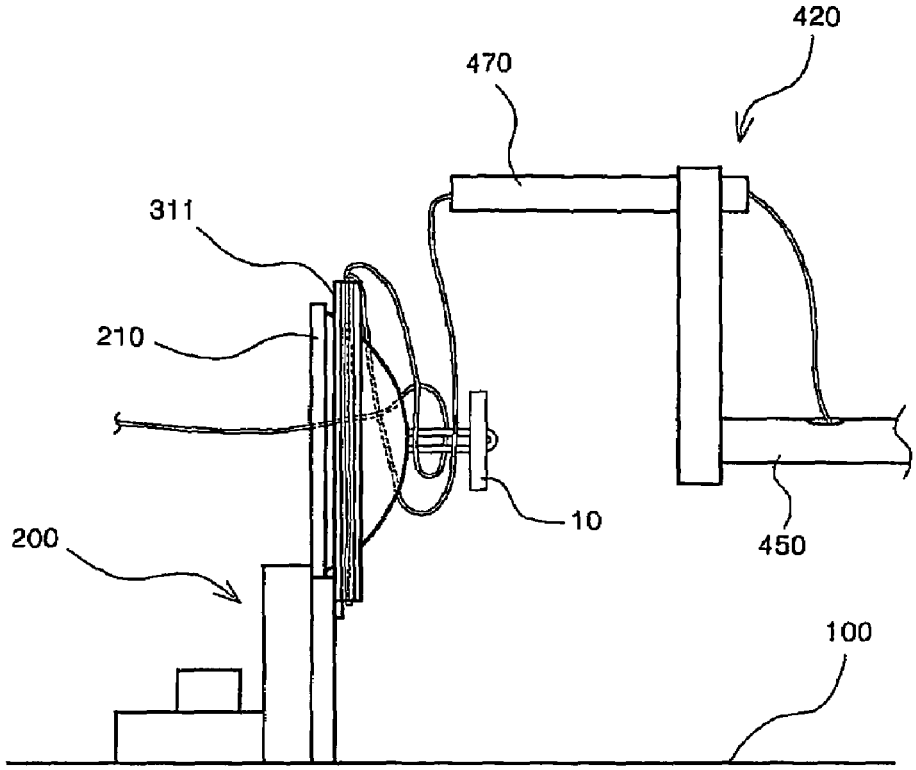
FIG. 22 is a front view illustrating a ninth state of the apparatus in accordance with the present invention.
Figure 23:
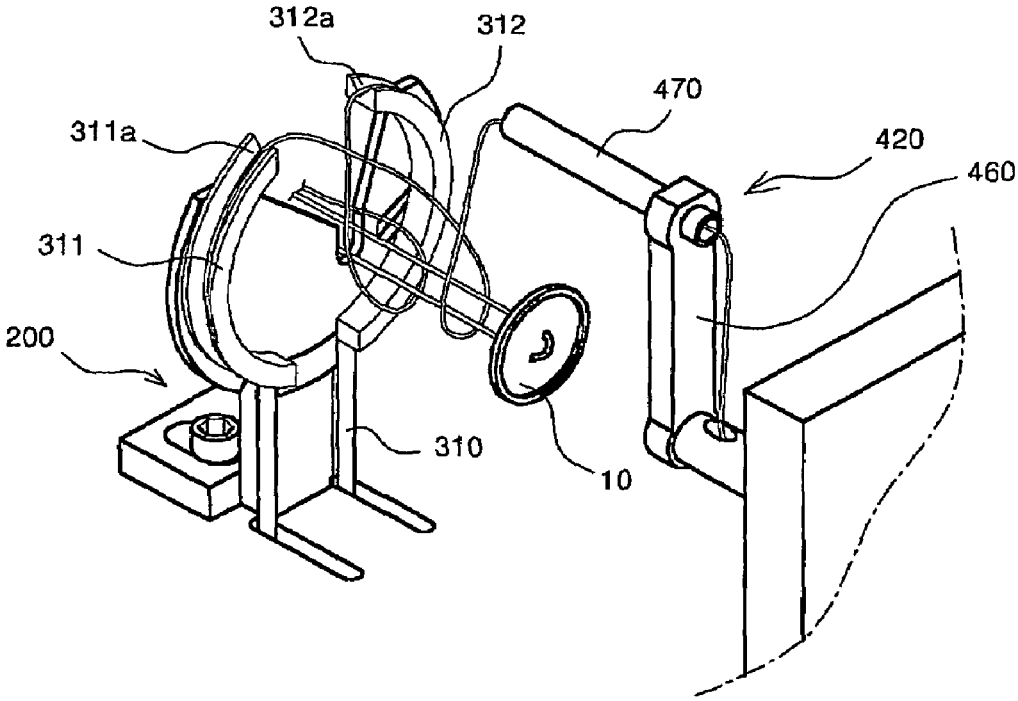
FIG. 23 is a perspective view of the apparatus in the ninth state of FIG. 22.

When the second tubular member 470 is further rotated by an angle of 360°, the second tubular member 470 is returned to the initial position. The position of the thread 20 in FIG. 22 corresponds to reference numeral ⑦ of FIG. 3.

Here, experiments conducted by the applicant revealed that the winding of the thread 20 around the sewing thread 11 of the button 10 plural times forms firm knots but causes a difficulty in disentangling the knots of the thread 20. Accordingly, most preferably, the winding of the thread 20 around the sewing thread 11 of the button 10 is performed once.

Thereafter, the knotting operation will be performed. Here, the winding means 400 moves more backwardly.

Then, the second driving means 600 is driven by the controller. When the second driving means 600 is driven, the knot-guiding means 300 and the thread take-up means 500 are simultaneously operated. The simultaneous operation of the knot-guiding means 300 and the thread take-up means 500 will be described in detail, as follows.

Briefly, the second driving means 600 is driven to cause the knot-guiding means 300 to move toward the winding means 400. Here, the guide arm 310 is rotated so that the arc-shaped upper ends 311 and 312 are folded close to each other.

Simultaneously, the thread take-up member 510 of the thread take-up means 500 is rotated downwardly as shown in FIG. 30. The thread 20 is drawn by the downwardly-rotated thread take-up member 510.

Figure 24:
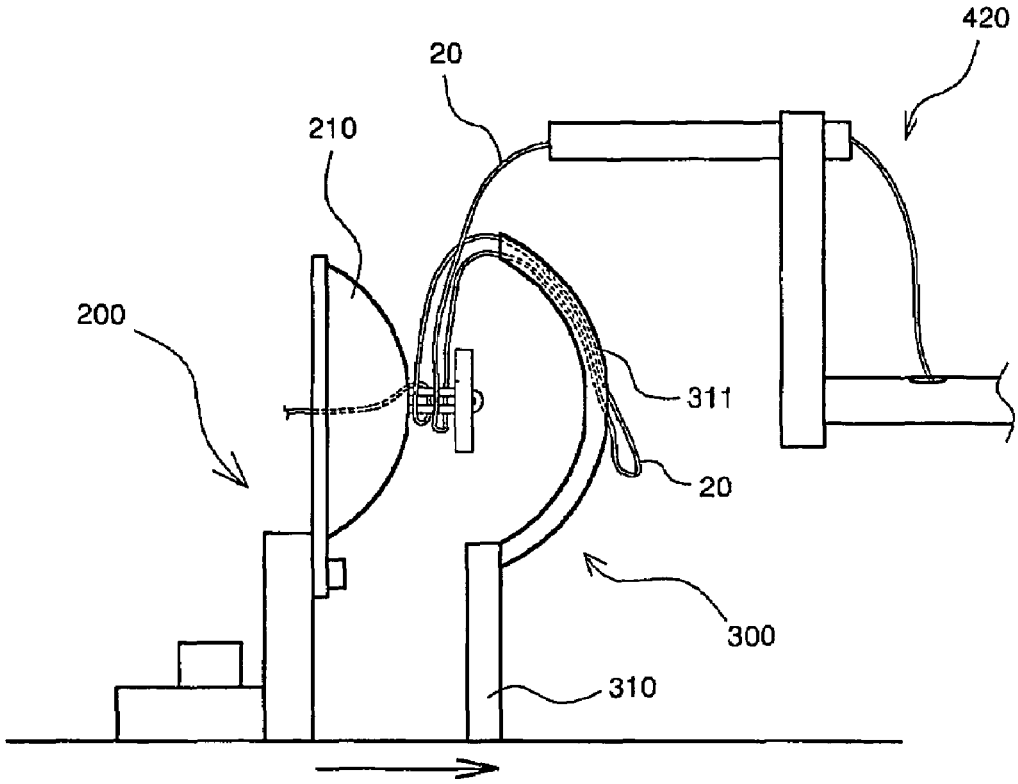
FIG. 24 is a front view illustrating a tenth state of the apparatus in accordance with the present invention.
Figure 25:
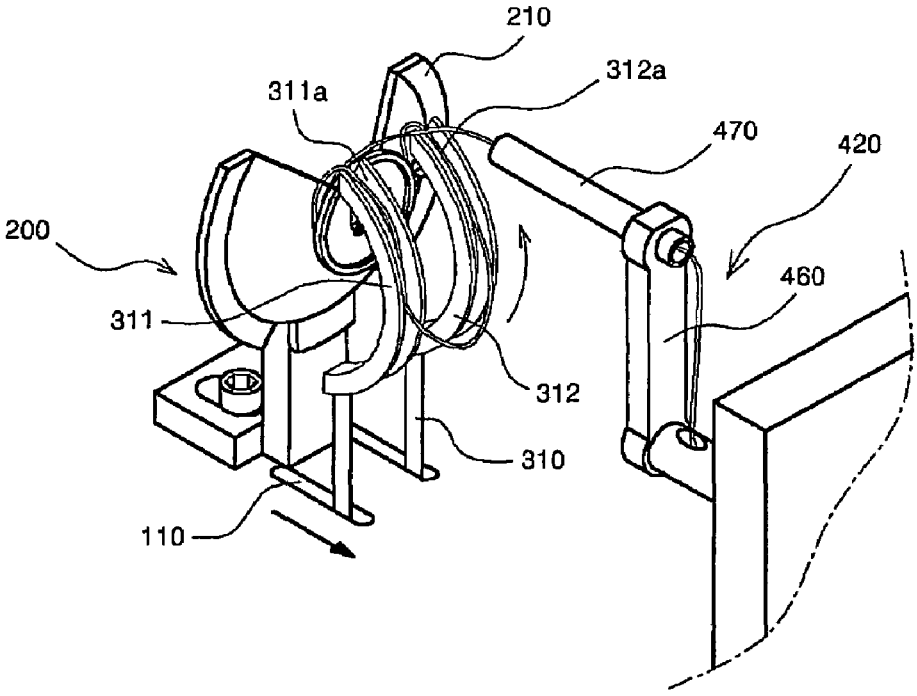
FIG. 25 is a perspective view of the apparatus in the tenth state of FIG. 24.
Figure 26:
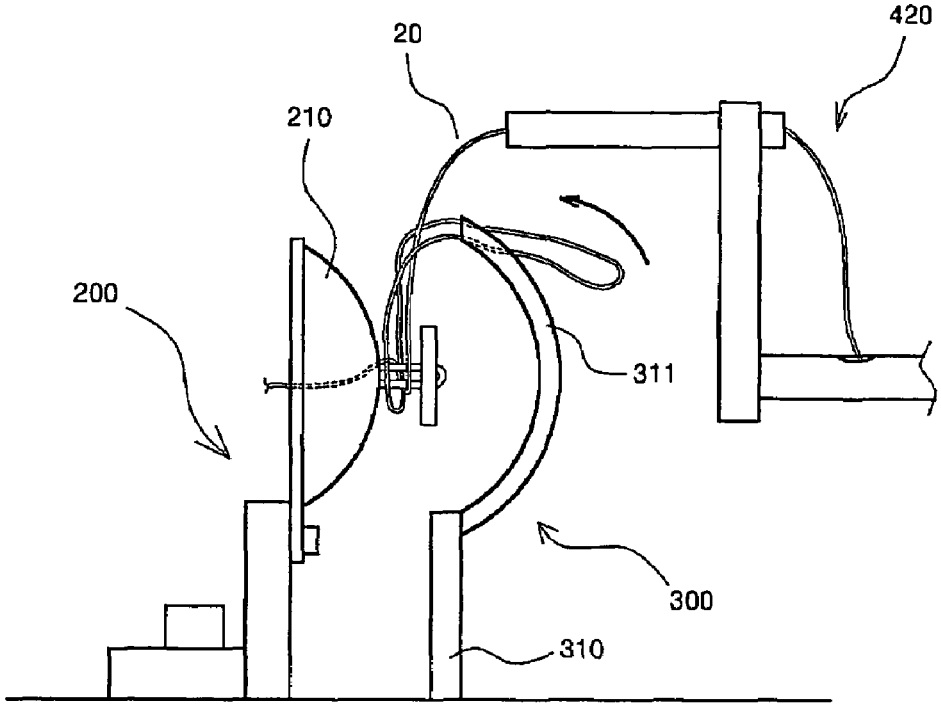
FIG. 26 is a front view illustrating an eleventh state of the apparatus in accordance with the present invention.

Now, the knotting operation will be described in detail. FIG. 24 illustrates the apparatus in a state, in which the arc-shaped upper ends 311 and 312 of the knot-guiding means 300 are folded, and FIG. 25 is a perspective view of the apparatus in the above state of FIG. 24. When the arc-shaped upper ends 311 and 312 are folded, the thread 20, which was inserted into the guide grooves 311*a* and 312*a*, is separated from the guide grooves 311*a* and 312*a* Since the lower parts of the guide grooves 311*a* and 312*a* have a comparatively smaller depth and the greatest tension is applied to a part of the thread 20 positioned at the lower parts of the guide grooves 311*a* and 312*a*, the separation of the thread 20 from the guide grooves 311*a* and 312*a* is started from the lower parts of the guide grooves 311*a* and 312*a*.

Accordingly, when the arc-shaped upper ends 311 and 312 are folded and the thread 20 is separated from the guide grooves 311*a* and 312*a* of the upper ends 311 and 312, the thread 20 is continuously drawn by the thread take-up member 510. The thread 20, which is separated from the guide grooves 311*a* and 312*a* and is loosened, is drawn along the arc-shaped portions of the arc-shaped ends 311 and 312 by the thread take-up member 510, and is then drawn close to the sewing thread 11 of the button 10.

Figure 1:
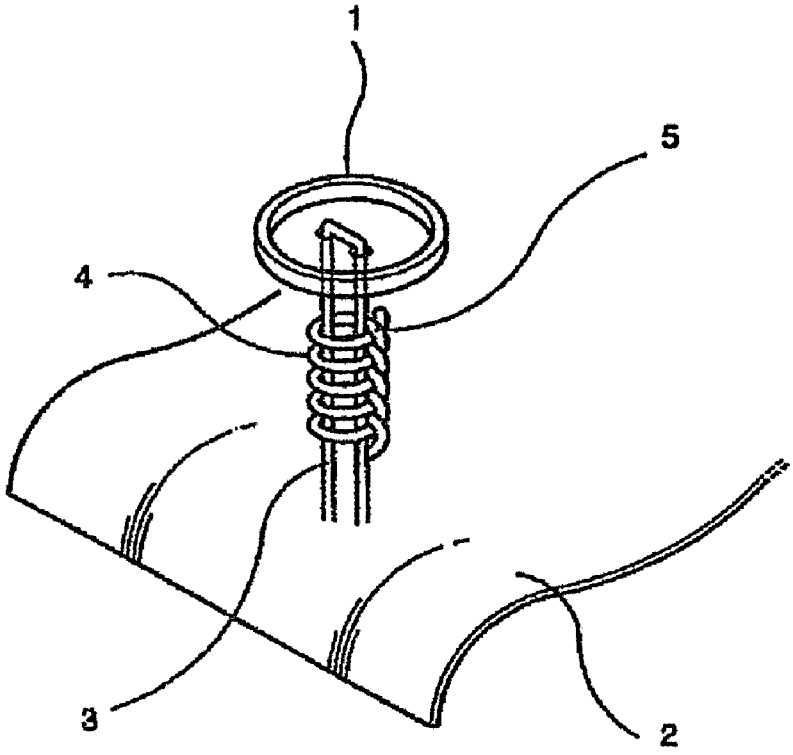
FIG. 1 (PRIOR ART)
FIG. 1 is a schematic view illustrating a conventional method for winding and knotting a thread around a sewing thread of a button for clothes.
Figure 2:
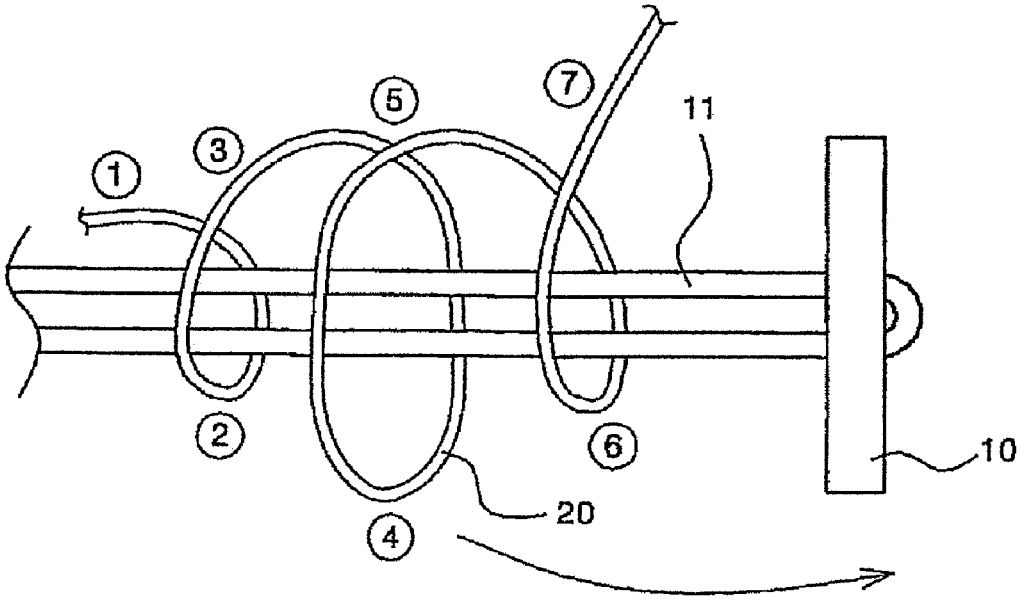
FIGS. 2 to 5 are schematic views illustrating a method for winding and knotting a thread around a sewing thread of a button for clothes in accordance with the present invention.
Figure 27:
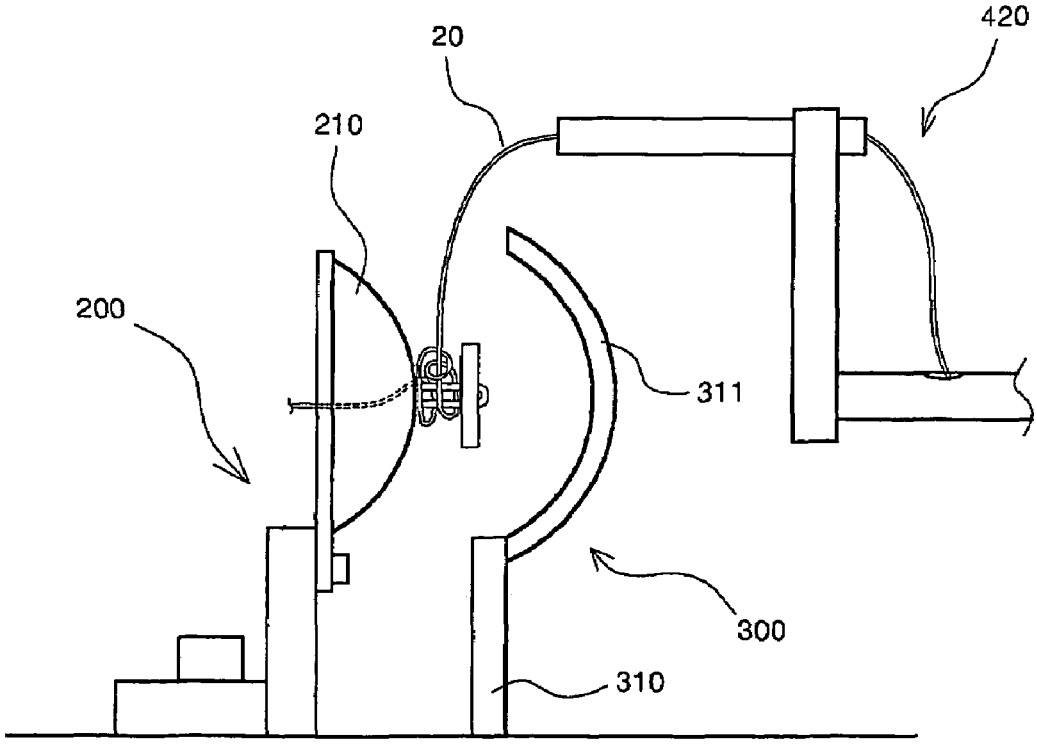
FIG. 27 is a front view illustrating a twelfth state of the apparatus in accordance with the present invention.

In case that the thread 20 is incompletely drawn, the thread 20 is completely drawn by the subsequent winding operation, and is knotted onto the sewing thread 11 of the button 10. That is, as shown in FIG. 27, the thread 20 is knotted. The above state, in which the thread 20 is knotted, is shown in FIGS. 2 and 3.

Hereinafter, the simultaneous operation of the knot-guiding means 300 and the thread take-up means 500 by means of the second driving means 600 will be described in detail.

Figure 28:
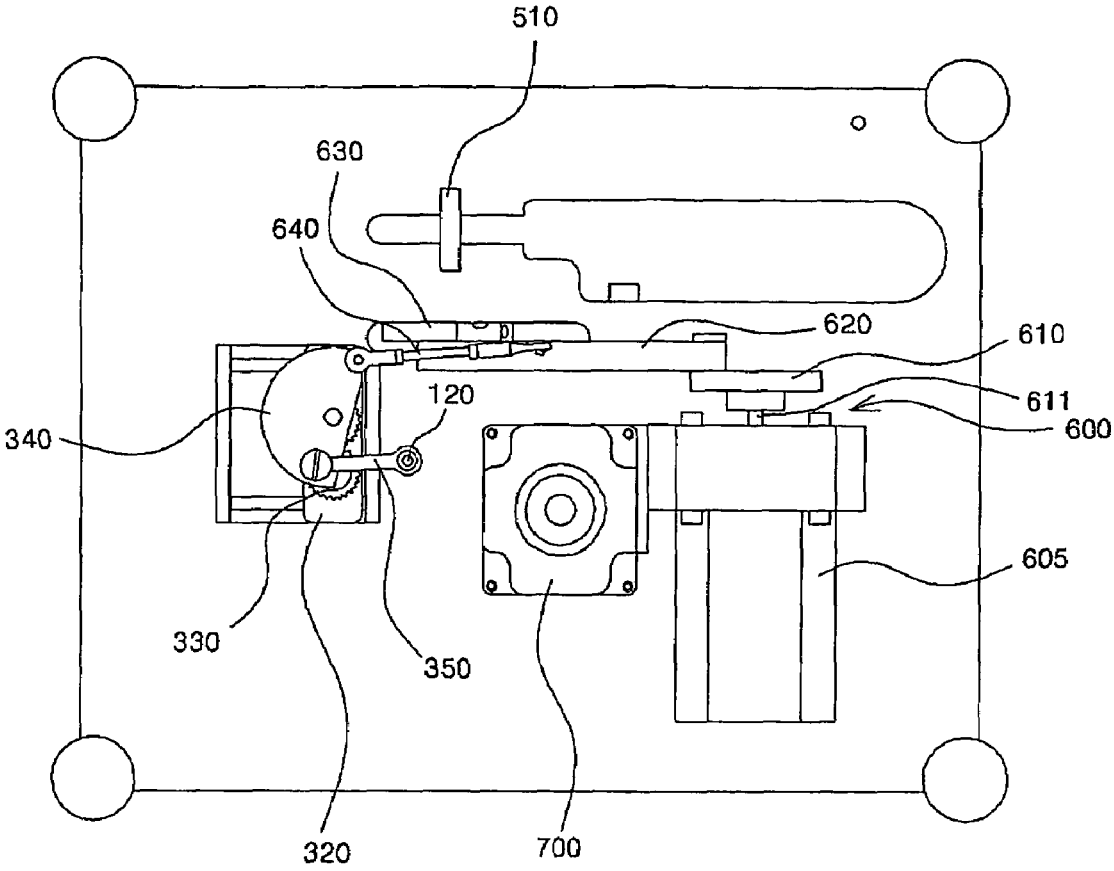
FIG. 28 is a bottom view of an apparatus for winding and knotting a thread around a sewing thread of a button for clothes in accordance with another embodiment the present invention, differing from the bottom view of the apparatus of FIG. 9.

The second driving means 600 is driven by the control of the controller (not shown) in order to knot the thread 20. The driving of the second driving means 600 is illustrated in FIGS. 9 and 28, which are respectively bottom views of the apparatus of the present invention, and FIGS. 29 and 30, which are respectively perspective views illustrating the operation of the knot-guiding means 300 and the thread take-up means 500 by means of the second driving means 600.

When the second driving means 605, attached to the lower surface of the base 100, is rotated, the driving plate 610 installed on one end of the driving shaft 611 of the second driving motor 605 is rotated, the second rod 620 provided with one end 621 fixed to the driving plate 610 reciprocates due to the rotation of the driving plate 610, and the third rod 630 and the fourth rod 640, connected to the second rod 620, move together.

When the fourth rod 640 is drawn, the driving plate 340 of the knot-guiding means 300 connected to the fourth rod 640 is drawn. Since one end of the driving plate 340 is connected to the first rod 350 connected to the stationary shaft 120 fixed to a designated area of the lower surface of the base 100 around the knot-guiding means 300, the above movement is performed. The guiding means-conveying member 320 slides from the feed shaft and is drawn, thereby causing the knot-guiding means 300 to be distant from the button-holding means 200.

Here, the driving plate 340 is rotated by the drawing force of the fourth rod 640, and the gear 330 formed on the lower end of the guide arms 310 is rotated together with the rotation of the driving plate 640 and the upper ends 311 and 312 of the guide arms 310 are folded toward the winding means 400.

When the upper ends 311 and 312 of the guide arms 310 are folded, the thread 20, which was inserted into the guide grooves 311*a* and 312*a*, is separated from the guide grooves 311*a* and 312*a*, and the thread take-up member 510 of the thread take-up means 500 is rotated downwardly by the second driving means 600, thus drawing the thread 20. Then, the thread 20 is guided by the arc-shaped circumference of the upper end 311 of the guide arm 310, passes through the upper part of the button 10, and tightly winds around the sewing thread 11 of the button 10, thereby being knotted.

The above-described operation is performed by the rotation of the second driving motor 605 of the second driving means 600 by an angle of 180°. When the second driving motor 605 is rotated by an angle of 360°, the knot-guiding means 300 and the thread take-up means 500 are returned to their initial positions.

Since the thread 20 is drawn downwardly together with the thread take-up member 510 of the thread take-up means 500, and then only the thread take-up member 510 is returned to its initial position, the thread 20 is in a loosened state. Although the thread 20 in the loosened state will be drawn through the subsequent winding operation, the thread 20 in the loosened state may be easily caught by other devices.

However, the apparatus of the present invention comprises the thread-straining member 520, having a designated length, provided with one end 523, which is fixed, and the other end 524, which is freely rotatable in a direction of its own weight and has the thread hole 521 formed therethrough, thereby straining the thread 20, which is loosened by the thread take-up operation of the thread take-up member 510, by the weight of the thread-straining member 520.

That is, since the thread-straining member 520 is provided with the thread hole 521, when the thread 20 passes the thread take-up member 510, the thread 20 passes through the thread hole 511 and the thread hole 521. In order to pull the thread 20 by a designated length by the thread take-up member 510, the gear unit 530 including the gear 531 fixedly connected to the thread take-up member 510 is rotated so that the thread take-up member 510 is rotated at a designated angle.

When the second driving motor 605 is rotated, the second rod 620 reciprocates by the rotation of the driving plate 610. Since the third rod 630 connected to the second rod 620 is connected to the other gear 532 of the heat unit 530, when the third rod 630 is rotated at a designated angle as shown in FIGS. 29 and 30, the gears 531 and 532 of the gear unit 530 are rotated by the rotation of the third rod 630, thereby rotating the thread take-up member 520 from the standard position to a designated position of maximally straining the thread 20.

One end of the thread-straining member 520 is rotatably connected to the thread take-up member 510 by a pin, and is provided with the thread hole 521 formed therethrough. Thus, when the thread-straining member 520 is rotated to strain the thread 20, the thread take-up member 510 is rotated also and is then returned to its initial position, but the thread-straining member 520 is lowered by the length of the sagging thread 20 in the loosened state, thereby continuously maintaining the straining state of the thread 20. Accordingly, the thread-straining member 520 prevents the thread 20 from being loosened and caught by other components.

Figure 31:
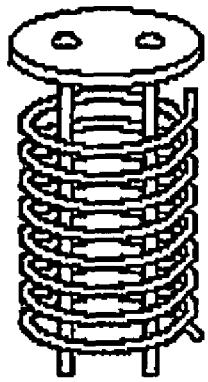
FIGS. 31, 32 and 33 are schematic views of other examples of the button, the sewing thread of which was wounded and knotted by the method in accordance with the present invention.
Figure 32:
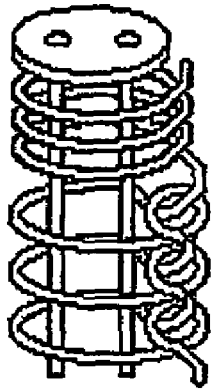
Figure 33:
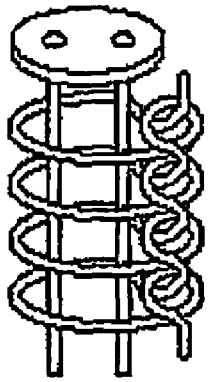

The apparatus of the present invention may perform only the winding operation. Accordingly, the apparatus may perform only the winding operation of the thread around the sewing thread of the button as shown in FIG. 31. Otherwise, the apparatus may perform the winding operation of the thread around the sewing thread of the button plural times and then the knotting operation of the thread as shown in FIG. 32, perform the knotting operation of the thread and then the winding operation of the thread around the sewing thread of the button plural times, perform only the knotting operation of the thread as shown in FIG. 32, or perform the winding operation of the thread and the knotting operation of the thread alternately.

INDUSTRIAL APPLICABILITY

As apparent from the above description, the present invention provides a method and apparatus for winding and knotting a thread around a sewing thread of a button for clothes, in which the thread is twisted at least twice and passes over the sewing thread of the button to form a firm knot of the thread around the sewing thread of the button, thereby preventing the thread from being disentangled from the sewing thread of the button.

Since guiding means accurately and reliably guides the thread to pass over the sewing thread of the button, no additional blowing device is required.

Since the thread, in a loosened state, when the thread passes over the sewing thread of the button, is strained by the thread take-up means, the thread firmly winds around the sewing thread of the button. Further, since the thread, which was loosened, after the thread take-up member of the thread take-up means strains the thread and is then returned to the initial position, strained by the thread-straining member, it is possible to prevent failures of the apparatus generated due to the loosened thread.

Since the knot-guiding means and the thread take-up means of the apparatus are simultaneously operated by a single driving means, it is possible to reduce production costs and energy consumption rate of the apparatus.

Accordingly, the apparatus and method of the present invention perform firm and effective winding of the thread around the sewing thread of the button as well as reduce production costs and energy consumption rate of the apparatus, and reduces failure rate, thereby improving reliability of winding and knotting the thread around the sewing thread of the button.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An apparatus for winding and knotting a thread around a sewing thread of a button for clothes, comprising:

a base, on which a plurality of components are installed;

button-holding means installed on the base for holding the button;

knot-guiding means installed in front of the button-holding means for guiding the thread so that the thread passes over the sewing thread protruded from the button held by the button-holding means to form a knot;

winding means, installed on an upper surface of the base, including a conveying stand moving back and forth toward the button-holding means, a winding arm for winding the thread around the sewing thread of the button, and first driving means for rotating the winding arm;

thread take-up means, installed on the base, including a thread hole formed through one side thereof for passing the thread and a thread take-up member for straining the thread when the thread passes over the sewing thread of the button;

second driving means installed on the base for simultaneously supplying power to the knot-guiding means and the thread take-up means; and tension means, for adjusting the tension of the thread, including a first tension member and a second tension member, between which the thread take-up means is positioned.

2. The apparatus as set forth in claim 1, wherein the knot-guiding means includes guide arms having arc-shaped upper ends so that the arc-shaped upper ends face each other and outer circumferences of the upper ends form a circle.

3. The apparatus as set forth in claim 1, wherein guide grooves, in which the thread is inserted, are respectively formed in the outer circumferences of the arc-shaped upper ends.

4. The apparatus as set forth in claim 1, wherein lower parts of the guide grooves have a depth smaller than those of other parts of the guide grooves.

5. The apparatus as set forth in claim 1, wherein the knot-guiding means includes:

bar-shaped guide arms, in a pair, positioned below the lower surface of the base and extended upwardly through a through hole of the base;

a guiding means-conveying member inserted into the lower ends of the guide arms and installed on a feed shaft for allowing the knot-guiding means to move back and forth;

gears respectively fixed to the lower ends of the guide arms so that the gears are engaged with each other; and a driving plate fixed to the lower end of one of the guide arms in a pair.

6. The apparatus as set forth in claim 5, wherein the knot-guiding means further includes a first rod having one end fixed to a designated position of the driving plate and the other end connected to a stationary shaft placed at a designated position of the lower surface of the base around the knot-guiding means.

7. The apparatus as set forth in claim 1, wherein the winding arm of the winding means includes:

a first tubular member connected to a rotary shaft of the first driving means by a belt;

a connection arm connected to one end of the first tubular member at right angles; and a second tubular member connected to the connection arm at right angles and extended toward the button-holding means in parallel with the first tubular member.

8. The apparatus as set forth in claim 7, wherein the first tubular member includes an outlet, for taking the thread therefrom, formed through one end thereof connected to the connection arm.

9. The apparatus as set forth in claim 1, further comprising a thread-straining member having one end, which is fixed to the thread take-up means by a pin, and the other end, which is freely rotatable and has a thread hole formed therethrough.

10. The apparatus as set forth in claim 1, wherein the second driving means includes:

a second driving motor attached to the lower surface of the base;

a driving plate installed on a driving shaft of the second driving motor;

a second rod provided with one end fixed to the driving plate by a rotary pin and extended in parallel with the driving plate;

a third rod provided with one end connected to the other end of the second rod and the other end fixedly connected to the other gear of the gear unit of the thread take-up means; and a fourth rod provided with one end connected to one end of the third rod and the other end connected to the driving plate of the knot-guiding means for supplying power of the second driving motor simultaneously to the knot-guiding means and the thread take-up means.

* * * * *